US006436210B1

(12) United States Patent
Groc et al.

(10) Patent No.: US 6,436,210 B1
(45) Date of Patent: Aug. 20, 2002

(54) SMOKE-GENERATING COMPOSITION BASED ON COLOPHONY DERIVATIVES

(75) Inventors: Philippe Groc, Lavernose; Daniel Grycza, Toulouse; Yann Guelou, Muret, all of (FR)

(73) Assignee: Etienne Lacroix Tous Artifices S.A. (FR)

( * ) Notice: Subject to any disclaimer, the term of this patent is extended or adjusted under 35 U.S.C. 154(b) by 0 days.

(21) Appl. No.: 09/583,080

(22) Filed: Aug. 9, 1999

(30) Foreign Application Priority Data

Aug. 10, 1998 (FR) ..... 98-10245

(51) Int. Cl.[7] ..... C06B 45/06; C06B 45/10
(52) U.S. Cl. ..... 149/18; 149/19.91
(58) Field of Search ..... 149/2, 4, 7, 75; 264/3.1

(56) References Cited

U.S. PATENT DOCUMENTS 4,523,967 A * 6/1985 Cartwright ..... 149/2
H233 H 3/1987 Tracy
4,978,482 A * 12/1990 Johnson et al. ..... 264/3.1
5,756,928 A * 5/1998 Ito et al. ..... 149/7
5,949,016 A * 9/1999 Baroody et al. ..... 149/18

FOREIGN PATENT DOCUMENTS

GB 1339516 12/1973

OTHER PUBLICATIONS

Elvers et al.: Ullmann's Encyclopedia of Industrial Chemistry, 5th revised ed., vol. A23 (1993), pp. 81, 84, and 86 (XP 002099878).

Chemical Abstracts, vol. 112, No. 24 (1990) (XP 000155896).

* cited by examiner

*Primary Examiner*—Michael J. Carone
*Assistant Examiner*—Aileen J. Baker
(74) *Attorney, Agent, or Firm*—Finnegan, Henderson, Farabow, Garrett & Dunner, L.L.P.

(57) ABSTRACT

A smoke-generating redox composition contains one or more esters of colophony or of hydrogenated colophony with an alcohol. Applications include use in a deterrent device.

15 Claims, No Drawings

SMOKE-GENERATING COMPOSITION BASED ON COLOPHONY DERIVATIVES

BACKGROUND OF THE INVENTION

1. Field of the Invention

The present invention relates to a smoke-generating redox composition containing one or more colophony or hydrogenated colophony ester derivatives.

The aim of the present invention is to provide a smoke-generating composition which satisfies the following specifications:

- the products used to make the smoke-generating composition, namely the combustion oxidizing agent, the combustion reducing agent and the smoke-generating agent, are nontoxic in the concentrations and the exposure times used,
- during its combustion, the smoke-generating composition generates an opaque smoke consisting of liquid and solid particles in the range from about 0.4 $\mu$m to about 0.7 $\mu$m in size,
- on cooling, the liquid particles crystallize and become invisible after deposition,
- the combustion particles do not adversely affect any material, such as textiles, or any equipment, in particular computer equipment.

2. Description of the Prior Art

Smoke-generating compositions which generate an opaque smoke by combustion include compositions based on terephthalic acid which are nontoxic but generate visible dusts and compositions based on colophony which are toxic but do not generate a visible deposit after combustion.

The present invention relates to a relatively nontoxic smoke-generating composition which leaves no visible deposit on objects after the smoke-generating agent has been fired off, which is particularly useful for firing off smoke-generating agents in a closed vessel, in particular when the smoke-generating agent is used in an alarm device or for checking the leaktightness of pipes.

SUMMARY OF THE INVENTION

More specifically, the present invention consists in a smoke-generating redox composition containing a combustion oxidizing agent, a combustion reducing agent and a smoke-generating agent which generates particles during its combustion and contains one or more colophony or hydrogenated colophony esters.

In the context of the present invention, the term "colophony" means the resinous residue from the distillation of terebenthine, which includes the oily resins extracted from conifers, in particular from the species *Pinus maritima, Pinus palustris, Pinus australis* and *Pinus caribaea.*

Colophony is a mixture of diterpenic acids consisting of

- about 90% of resinous acids of empirical formula $C_{20}H_{30}O_2$, the main isomers of which are abietic acid, levopimaric acid and dextropimaric acid, of structural formulae abietic acid

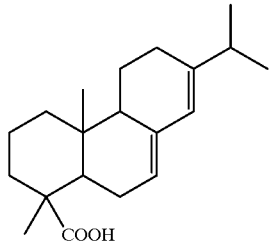

levopimaric acid

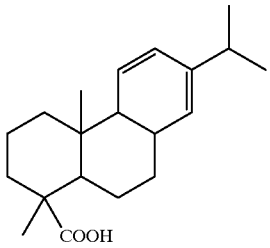

dextropimaric acid

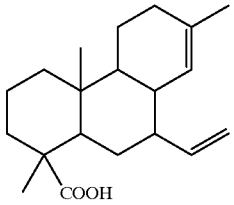

- about 10% of a mixture of dihydroabietic acid of empirical formula $C_{20}H_{32}O_2$ and dehydroabietic acid of empirical formula $C_{20}H_{28}O_2$, of structural formulae dihydroabietic acid

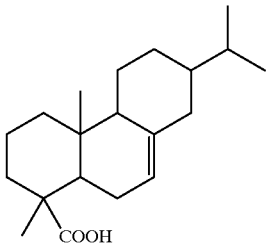

dehydroabietic acid

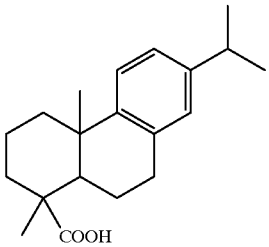

Abietic acid is the main constituent of colophony.

In the context of the present invention, the term "hydrogenated colophony" means the result of the hydrogenation of colophony, which is a hydrogenated mixture of the preceding diterpenic acids.

The hydrogenated abietic acid of formula

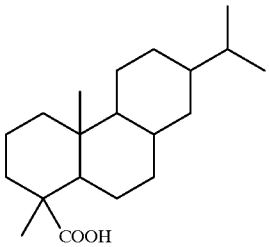

is the main constituent of hydrogenated colophony.

The smoke-generating composition according to the invention contains one or more colophony or hydrogenated colophony esters. The ester(s) is (are) obtained from colophony or hydrogenated colophony and an alcohol, which is preferably a polyol.

The polyol is advantageously chosen from glycerol and pentaerythritol.

The smoke-generating composition of the invention also contains a combustion oxidizing agent preferably chosen from chlorates, for instance potassium chlorate.

The smoke-generating composition of the invention also contains a combustion reducing agent, preferably lactose.

The smoke-generating composition advantageously contains 30% to 55% by weight of smoke-generating agent, 25% to 40% by weight of combustion oxidizing agent and 20% to 30% by weight of combustion reducing agent.

One aspect of the present invention is the use of the smoke-generating composition described above for checking the leaktightness of ducts, in particular flues and tunnels.

Another aspect of the present invention is the use of the smoke-generating composition described above in a deterrent device, in particular an anti-intrusion alarm system.

Finally, the present invention is useful in smoke identification tests, in particular fire detection tests.

DETAILED DESCRIPTION OF THE PREFERRED EMBODIMENT

The present invention is illustrated by the example below, which is given without any implied limitation of the invention.

EXAMPLE

A smoke-generating composition containing 41% ester of glycerol and colophony, 26% lactose, 28% potassium chlorate and 5% magnesium carbonate was prepared.

The toxicity of the smoke-generating composition was evaluated by exposing two batches, each consisting of 5 male rats and 5 female rats, to the combustion products of the smoke-generating composition.

The first batch was exposed for one hour, and the second batch for two hours, to an average concentration of smoke-generating agent (mixture of solid, liquid and gaseous products) in the range from 2.6 g/m$^3$ to 2.7 g/m$^3$.

After firing off the smoke-generating agent, the rats were observed to experience an immediate difficulty in breathing. This breathing difficulty is reflected by dyspnoea, a brownish-colored nose, hypersalivation and noisy breathing.

This difficulty was greater in the animals of the second batch which were exposed for two hours, which reflected a dose effect (longer exposure time).

The breathing difficulty disappeared, for both batches, after 24 hours.

The animals were observed for two weeks following their exposure. No macroscopic anomalies were found for the animals at the end of the two weeks of observation.

An additional toxicity study was also carried out at higher concentrations of smoke-generating agent. Specifically, after testing a concentration of about 3 g/m$^3$ for one to two hours, we became interested in the effects of a high concentration of about 8 g/m$^3$, for a short exposure time of 15 minutes.

No deaths were recorded during the test or during the two weeks of observation.

As indicated above, the smoke-generating composition according to the invention also finds an application in smoke identification tests, in particular fire detection tests.

These standard fires are considered as representative of the components of a fire.

These smoke-generating agents were also tested in fire detection tests. In a first stage, it was necessary to carry out tests to identify the smoke emitted by the smoke-generating agent, in accordance with the European standard EN 54, part 9, published in July 1982.

This standard defines 6 standard fires:

A cellulosic open fire produced by 70 openly stacked small beechwood logs lit by an alcohol fire (TF 1)

A smoldering pyrolysis fire consisting of 24 small beechwood logs placed on a heating plate (TF 2)

A smoldering fire with live coals, produced by cotton wool (TF 3)

A polyurethane open fire (TF 4)

A fire of 650 g of heptane (TF 5)

A fire of 2 000 g of ethyl alcohol (TF 6)

These standard fires are considered as representative of the components of a fire.

The smoke-generating composition which is the subject of the present invention has the particular feature of emitting fumes representative of a fire of the TF 3 type.

There is claimed:

1. A smoke-generating redox composition containing a combustion oxidizing agent, a combustion reducing agent and a smoke-generating agent which generates particles during its combustion and contains one or more colophony or hydrogenated colophony esters.

2. The smoke-generating composition as claimed in claim 1, wherein said ester(s) is (are) obtained from colophony or hydrogenated colophony and an alcohol which is a polyol.

3. The smoke-generating composition as claimed in claim 2, wherein said polyol is chosen from glycerol and pentaerythritol.

4. The composition as claimed in claim 1, wherein said combustion oxidizing agent is a chlorate salt and a mixture thereof.

5. The composition as claimed in claim 1, wherein said combustion reducing agent is lactose.

6. The composition as claimed in claim 1 which comprises 30% to 55% by weight of smoke-generating agent, 25% to 40% by weight of combustion oxidizing agent and 20% to 30% by weight of combustion reducing agent.

7. An intruder deterrent system comprising:

the composition of claim 1; and an intruder detector operably linked to said composition; wherein activation of the intruder detector results in production of smoke by combustion of said composition.

8. A system for testing the leaktightness of ducts, comprising:

the composition of claim 1; and a device for combusting said composition.

9. A method for deterring an intruder comprising:

combusting the composition of claim 1 in the proximity of the intruder.

10. A method for detecting leaks in a duct comprising:

combusting the composition of claim 1 to produce smoke;

forcing the smoke into the duct; and monitoring the duct for the escape of smoke.

11. A method for testing smoke-detection equipment comprising:

combusting the composition of claim 1 to produce smoke;

bringing the smoke into contact with the smoke-detection equipment; and monitoring the equipment for a positive detection signal.

12. A smoke composition produced by combusting an oxidizing agent, a reducing agent, and a smoke-generating agent comprising one or more colophony or hydrogenated colophony esters.

13. The smoke composition of claim 12, comprising particles ranging in size from about 0.4 microns to about 0.7 microns.

14. A smoke composition comprising:

combustion products of an oxidizing agent;

combustion products of a reducing agent;

and combustion products of a smoke-generating agent comprising one or more colophony or hydrogenated colophony esters.

15. A method of making smoke comprising combusting an oxidizing agent, a reducing agent, and a smoke-generating agent having one or more colophony or hydrogenated colophony esters.

* * * * *